US007533833B2

(12) United States Patent
Wang et al.

(10) Patent No.: US 7,533,833 B2
(45) Date of Patent: May 19, 2009

(54) WATERING NOZZLE ASSEMBLY WITH MIST MODE

(76) Inventors: King-Yuan Wang, P.O. Box 215, Taichung (TW); Shun-Nan Lo, P.O. Box 215, Taichung (TW)

( * ) Notice: Subject to any disclaimer, the term of this patent is extended or adjusted under 35 U.S.C. 154(b) by 0 days.

(21) Appl. No.: 11/339,563

(22) Filed: Jan. 26, 2006

(65) Prior Publication Data

US 2007/0138321 A1 Jun. 21, 2007

(30) Foreign Application Priority Data

Dec. 19, 2005 (TW) ..... 94144996 A

(51) Int. Cl.
*B05B 9/01* (2006.01)

(52) U.S. Cl. ..... 239/526; 239/443; 239/449; 239/488; 239/489; 239/539

(58) Field of Classification Search ..... 239/525, 239/526, 391, 392, 394, 443–449, 456, 457, 239/460, 463, 464, 476, 477, 478–491, 538, 239/539

See application file for complete search history.

(56) References Cited

U.S. PATENT DOCUMENTS

| | | | | |
|---|---|---|---|---|
| 4,909,443 | A * | 3/1990 | Takagi | 239/440 |
| 5,979,800 | A * | 11/1999 | Takagi | 239/440 |
| 7,226,002 | B2 * | 6/2007 | Luo | 239/526 |
| 7,240,858 | B2 * | 7/2007 | Wang | 239/526 |

* cited by examiner

*Primary Examiner*—Christopher S Kim

(57) ABSTRACT

A watering nozzle assembly includes an adjustment member received in the barrel and an outlet device is connected to the adjustment member. The outlet device includes a rotatable member, a collar mounted to the rotatable member and a nozzle member connected to the rotatable member. An intermediate member is located between the rotatable member and the nozzle member. One side of the intermediate member has a plurality of rods and passages. Multiple apertures are defined in an outer periphery of the nozzle member. Multiple cone-shaped recesses are defined in an inner periphery of the nozzle member and enclose the apertures respectively. Multiple spiral grooves are defined in each of the cone-shaped recesses. When the cone-shaped recesses are sealed by the rods and a part of each of the spiral grooves are exposed beyond the rods so that mist water goes out from the apertures via the spiral grooves.

9 Claims, 12 Drawing Sheets

WATERING NOZZLE ASSEMBLY WITH MIST MODE

FIELD OF THE INVENTION

The present invention relates to a watering nozzle assembly, which provides tiny water particles.

BACKGROUND OF THE INVENTION

A conventional watering nozzle assembly generally includes a function that provides different patterns of watering so as to meet requirements when gardening. The patterns can be a strong water stream, several small water streams, cone-shaped water streams, and circular water streams. These patterns meet most of the requirements for gardening. Nevertheless, the water particles of all of the water streams are too large for some plants or flowers and might hurt them when the water drops hit the plants. A watering nozzle assembly that generates mist watering pattern is needed.

The present invention intends to provide a watering nozzle assembly which includes multiple types of watering patterns and one of the watering patterns is a mist watering pattern which can be easily made by operating the outlet device.

SUMMARY OF THE INVENTION

The present invention relates to a watering nozzle assembly which comprises a handle with an inlet tube received therein and a barrel is connected to the handle. An outlet tube is connected to the inlet tube and received in the barrel. An adjustment member is received in the barrel and an outlet device is connected to the adjustment member. The outlet device includes a rotatable member, a collar mounted to the rotatable member and a nozzle member connected to the rotatable member. An intermediate member is located between a first inner tube of the rotatable member and a second inner tube of the nozzle member. One side of the intermediate member has a plurality of rods and passages. A tubular portion extends from the other side of the intermediate member and is inserted into the first inner tube of the rotatable member. A plurality of slots are defined in the tubular portion. The nozzle member includes a divergent cone-shaped surface and a central hole. A plurality of apertures are defined in an outer periphery of the nozzle member. A plurality of cone-shaped recesses are defined in an inner periphery of the nozzle member and enclose the apertures respectively. A plurality of spiral grooves are defined in each of the cone-shaped recesses. The cone-shaped recesses are sealed by the rods and a part of each of the spiral grooves are exposed beyond the rods so that mist water goes out from the apertures via the spiral grooves.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 2-1 shows the intermediate member to be connected with the nozzle member;

FIG. 2-2 shows another embodiment of the nozzle member;

FIG. 2-3 shows another embodiment of the intermediate member;

FIG. 3 is a perspective view to show the watering nozzle assembly of the present invention;

DETAILED DESCRIPTION OF THE PREFERRED EMBODIMENT

Figure 1:
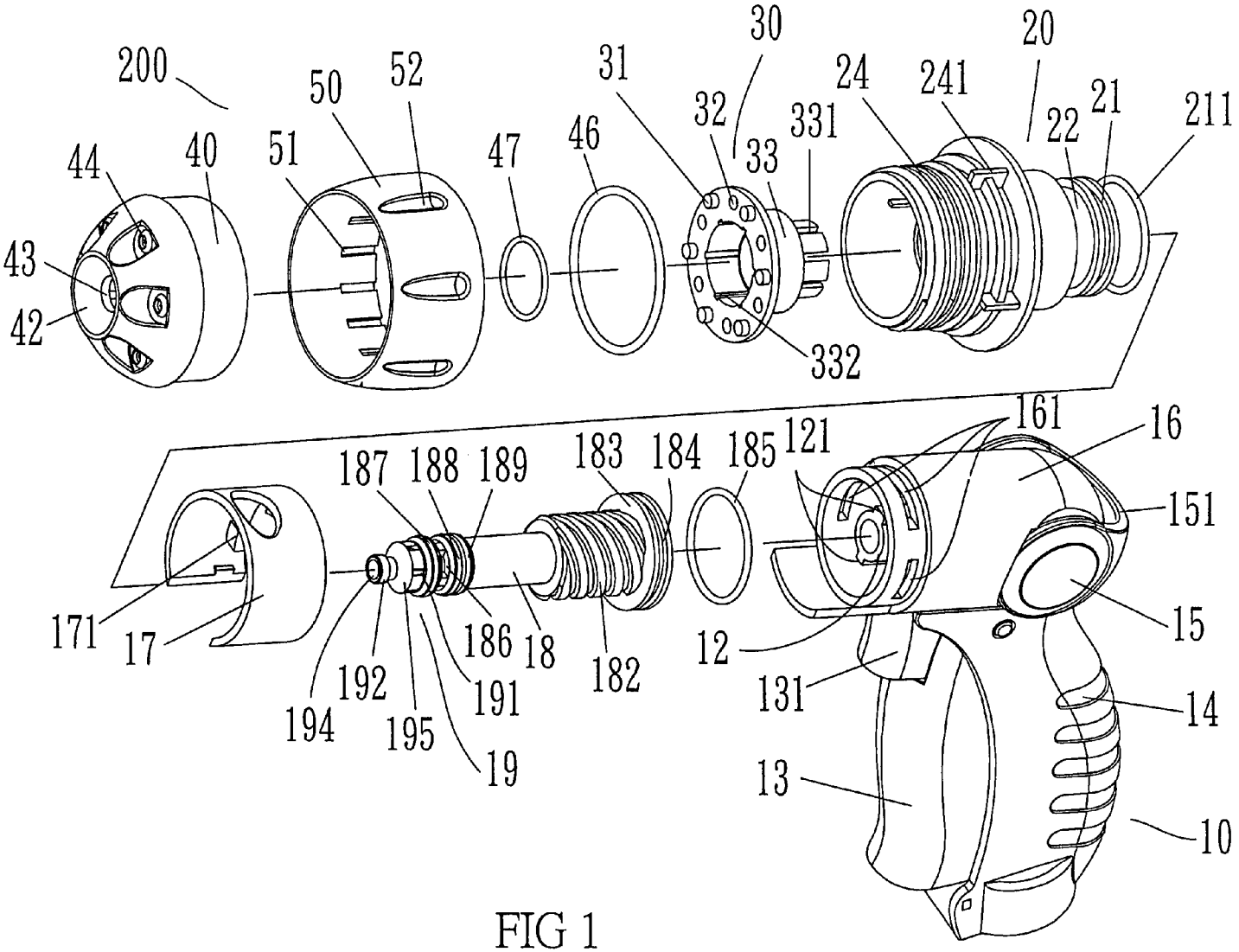
FIG. 1 is an exploded view to show the watering nozzle assembly of the present invention.

Referring to FIGS. 1, 2, 2-1, 3 and 4, the watering nozzle assembly 10 of the present invention comprises a handle 14 with an inlet tube 11 received therein so as to be connected with a hose (not shown) to introduce water in the assembly 10. A barrel 16 is connected to the handle 14 and an outlet tube 12 received in the barrel 16 is connected to the inlet tube 11. A trigger 13 is pivotably connected to the handle 14 and a locking piece 131 is connected to the trigger 13 to lock the trigger 13 at a desired position. A control valve 15 is located at a side of the barrel 16 and a control knob 151 is connected to the control valve 15.

An adjustment member 18 is received in the barrel 16 and an outlet device 200 connected to the adjustment member 18. The outlet device 200 includes a rotatable member 20, a collar mounted to the rotatable member 20 and a nozzle member 40 connected to the rotatable member 20.

The adjustment member 18 includes an outer threaded section 182 and a flange 183 extends radially from a first end of the adjustment member 18. A groove 184 is defined in an outer periphery of the flange 183 and a seal 185 is engaged with the groove 184 so as to be in contact with an inner periphery of the barrel 16. A second end of the adjustment member 18 is a closed end and includes side holes 186 defined a wall thereof. A first seal member 187, a second seal member 188 and a third seal member 189 are respectively mounted to the adjustment member 18, wherein the side holes 186 are located between the first and second seal members 187, 188. An end part 19 is mounted to the second end of the adjustment member 18 and includes a plurality of through holes 191. A neck 192 is defined in a distal end of the end part 19 and an orifice 193 is defined axially in the neck 192 and communicates with the through holes 191. The orifice 193 defines a cone-shaped opening 194 in a distal end of the neck 192. The outlet tube 12 includes rails 121 and the adjustment member 18 includes guide grooves 181 (FIG. 4) with which the rails 121 are linearly and movably engaged.

The rotatable member 20 includes an annular groove 21 and a seal 211 is engaged with the annular groove 21 and in contact with an inner periphery of the barrel 16. A retaining member 17 is mounted on the barrel 17 and includes studs 171 on an inner periphery thereof such that the studs 171 are engaged with a retaining groove 22 defined beside the annular groove 21 of the rotatable member 20. The rotatable member 20 includes an inner threaded hole 23 and the outer threaded section 182 of the adjustment member 18 is threadedly connected to the inner threaded hole 23. A first chamber 25 is defined between the first inner tube 231 of the rotatable member 20 and an outer threaded tube 24 on an end pf the rotatable member 20. A plurality of blocks 241 extending radially from the rotatable member 20 and a collar 50 is mounted to the rotatable member 20. The collar 50 includes engaging grooves 51 defined in an inner periphery thereof so as to be engaged with the blocks 241.

An intermediate member 30 is located between a first inner tube 231 of the rotatable member 20 and a second inner tube 45 of the nozzle member 40. One side of the intermediate member 30 has a plurality of rods 31 and passages 32. A tubular portion 33 extends from the other side of the intermediate member 30 and is inserted into the first inner tube 231 of the rotatable member 20. A plurality of slots 331 are defined in the tubular portion 33.

Figure 2:
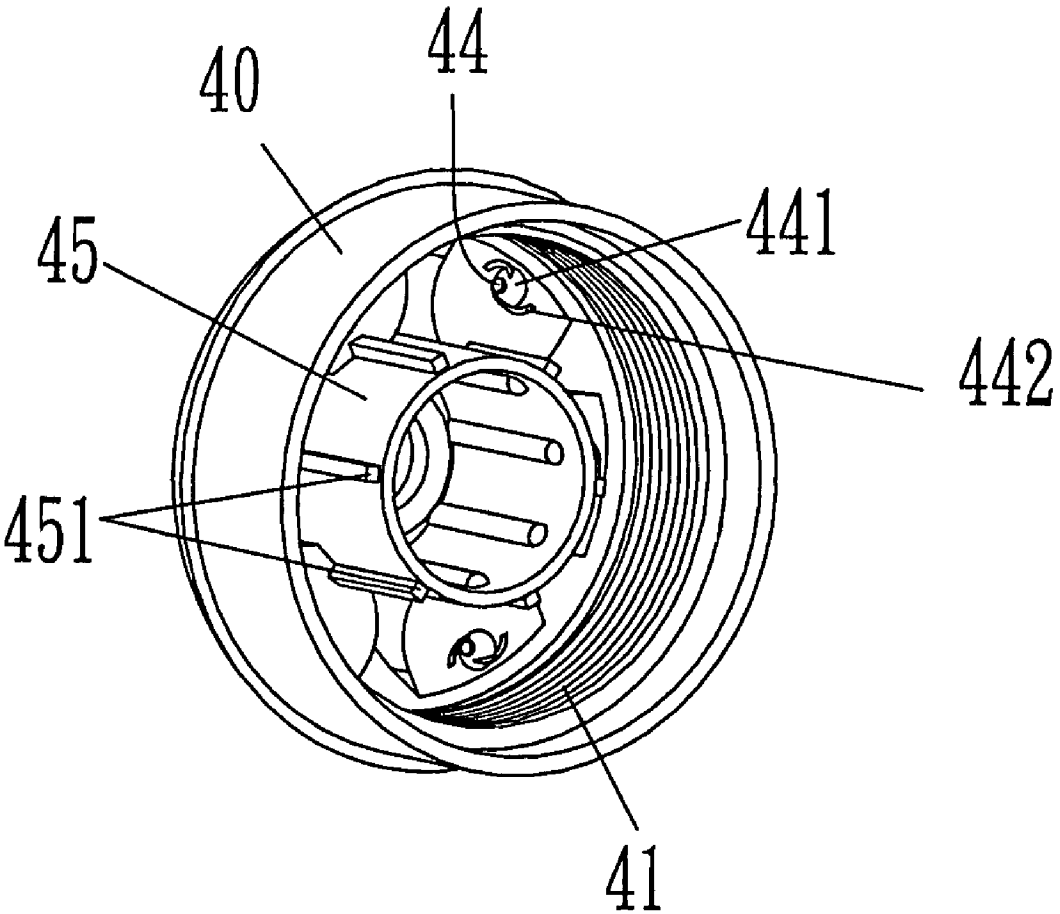
FIG. 2 is a perspective view to show an inner periphery of the nozzle member of the present invention.
Figures 1, 2:
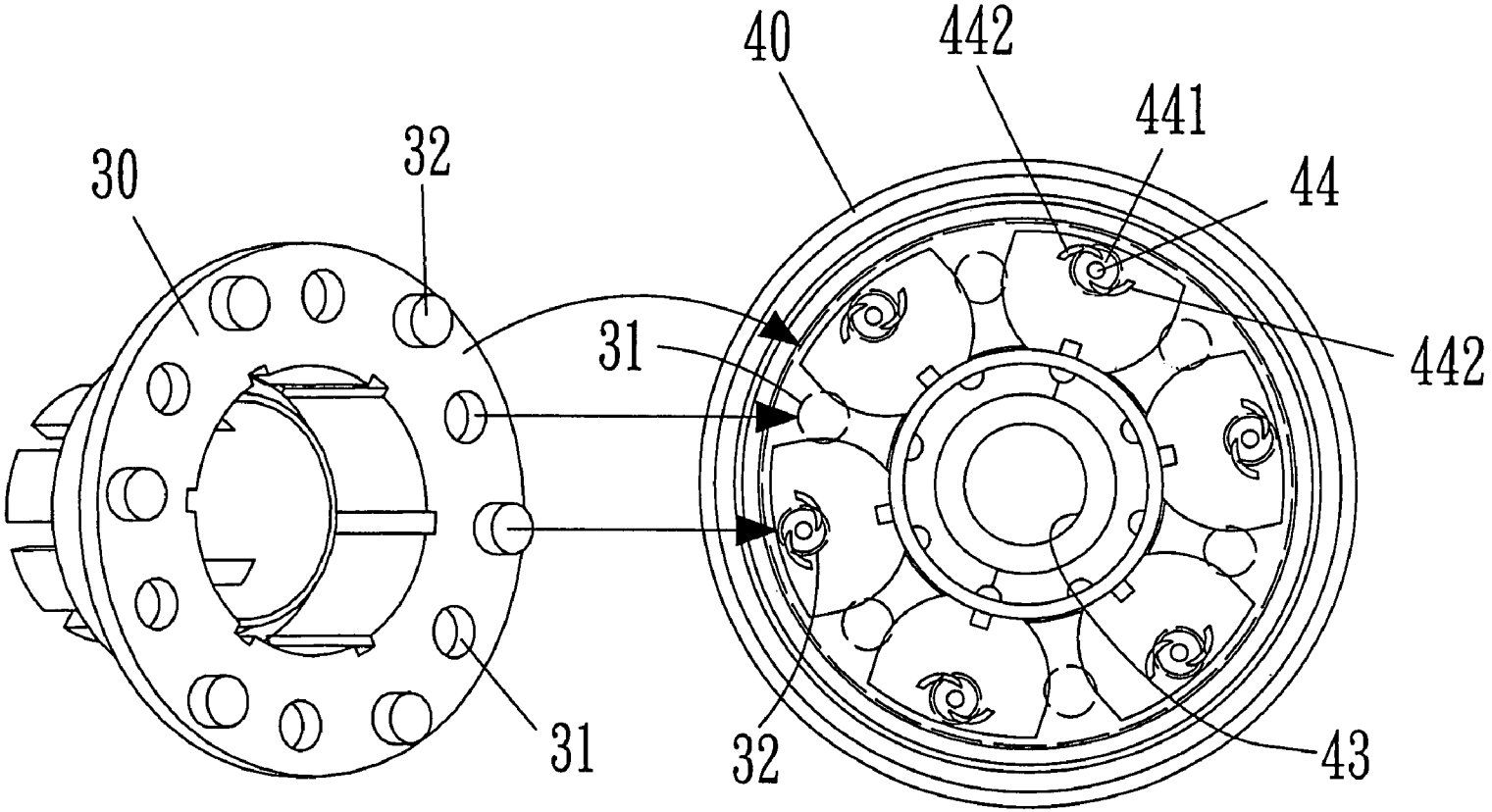
Figure 2:
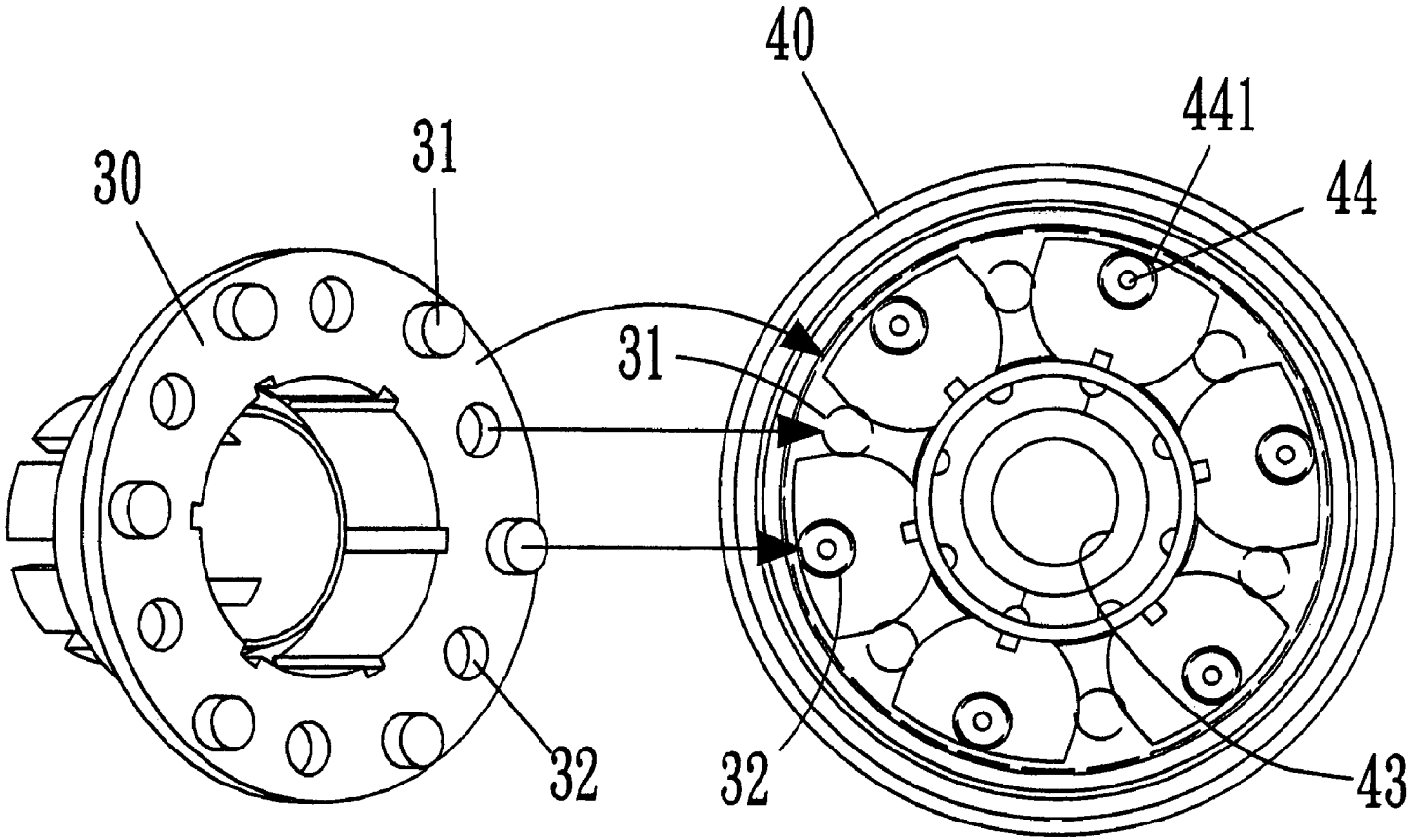
Figures 2, 3:
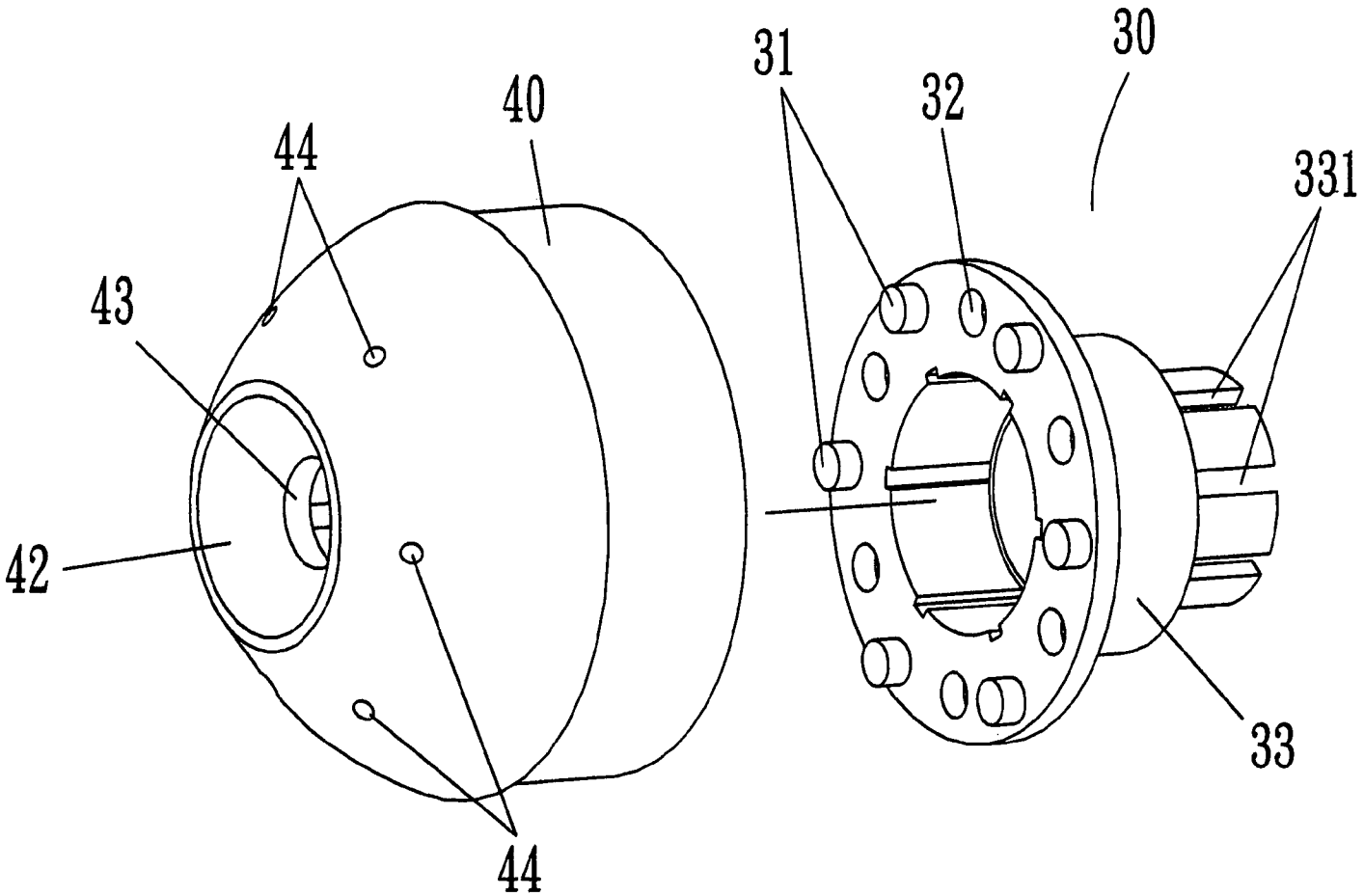
Figure 3:
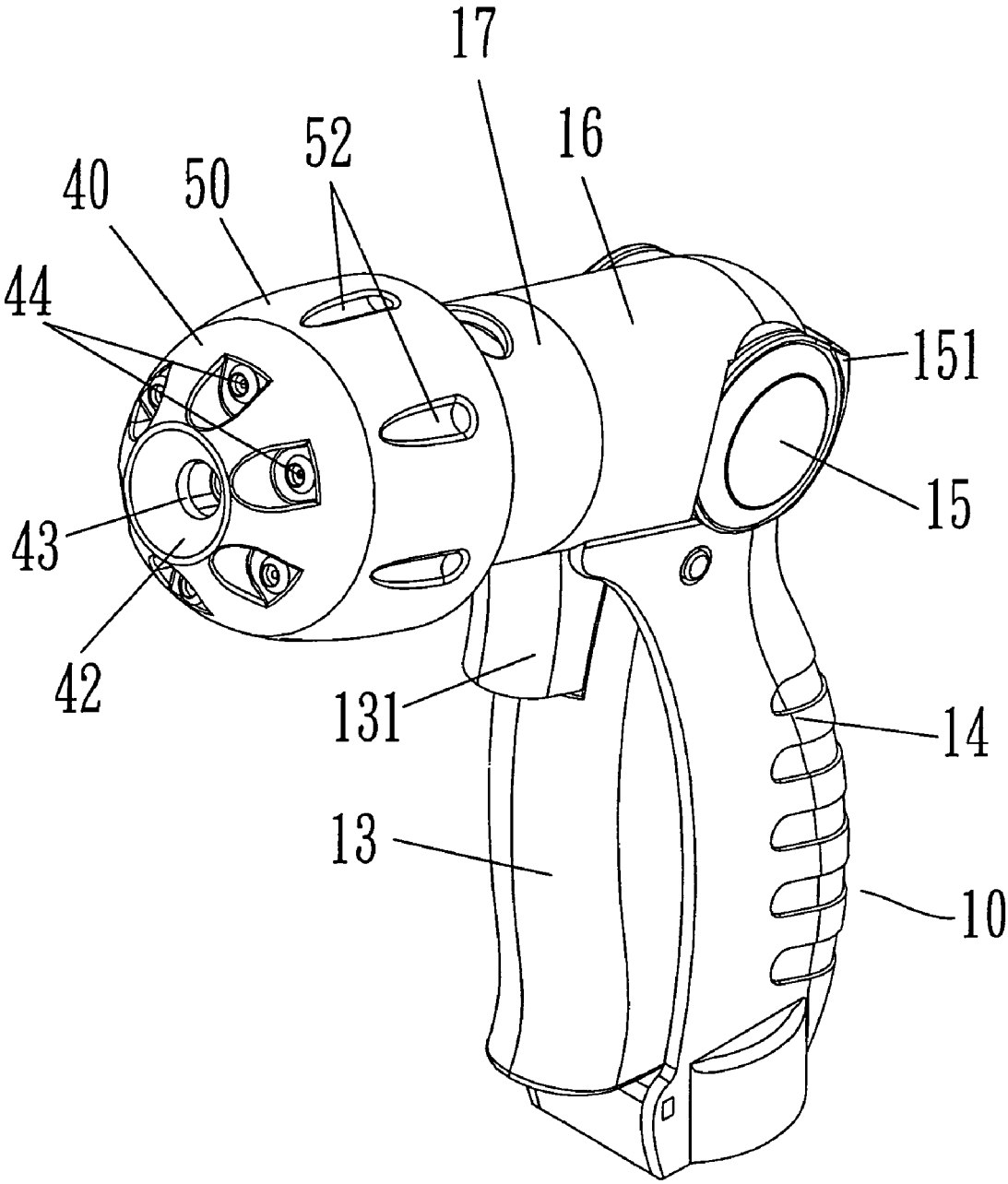
Figure 4:
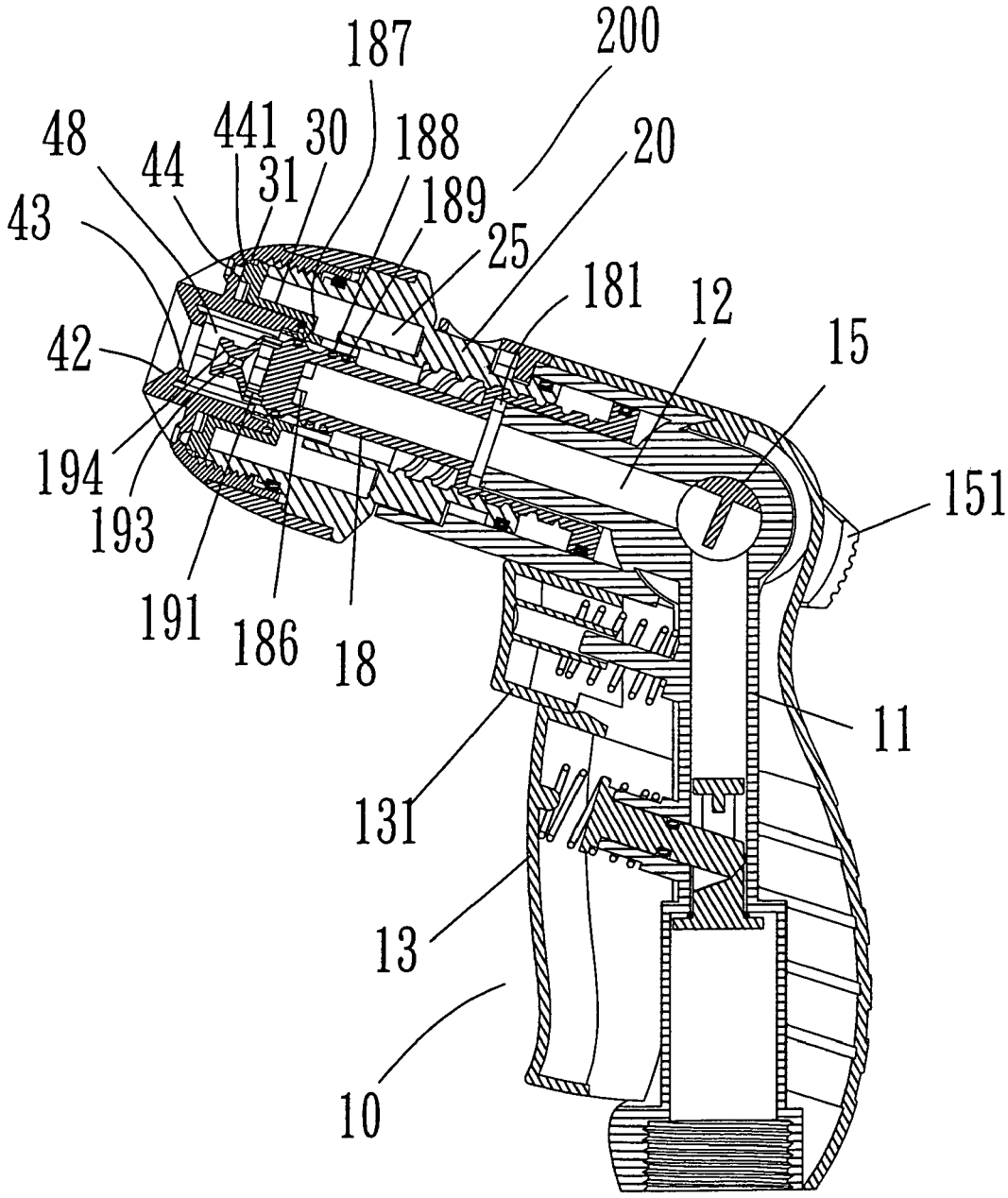
FIG. 4 is a cross sectional view to show the watering nozzle assembly of the preset invention.

The nozzle member 40 includes an inner threaded section 41 which is connected to the outer threaded tube 24 of the rotatable member 20. A seal 46 is clamped between the rotatable member 20 and the nozzle member 40, and another seal 47 is clamped between the second inner tube 45 and the adjustment member 30. The nozzle member 40 includes a divergent cone-shaped surface 42 and a central hole 43. A plurality of apertures 44 are defined in an outer periphery of the nozzle member 40 and a plurality of L-shaped recesses are defined in the outer periphery of the nozzle member 40 and the apertures 44 are located in the vertical portion of the L-shaped recesses. As shown in FIG. 2-3, the L-shaped recesses can also me omitted and the apertures 44 are defined through the cone-shaped outer periphery of the nozzle member 40. A plurality of cone-shaped recesses 441 are defined in an inner periphery of the nozzle member 40 and enclose the apertures 44 respectively. A plurality of spiral grooves 442 are defined in each of the cone-shaped recesses 441. A plurality of inner grooves 332 are defined in the tubular portion 33 of the intermediate member 30 and the second inner tube 45 of the nozzle member 40 includes ribs 451 which are movably engaged with the inner grooves 332.

Figure 5:
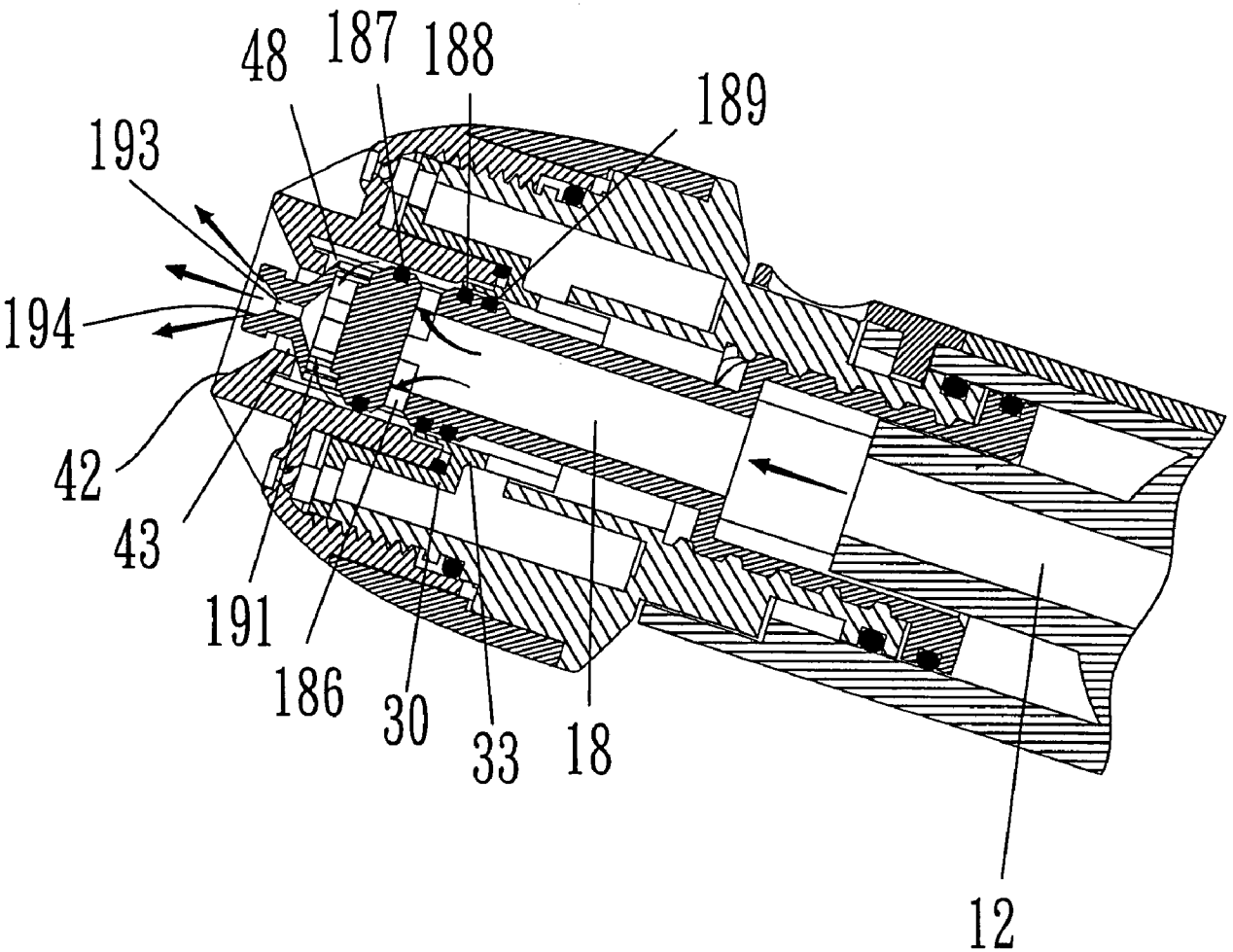
FIGS. 5 to 9 show different status of the watering nozzle assembly of the present invention.

Referring to FIG. 5, when the adjustment member 18 moves and the inclined surface 195 on the neck 192 of the end part 19 seals the central hole 43 of the nozzle member 40, the side holes 186 are located in the second chamber 48 and a gap is defined between the first seal member 187 and the second inner tube 45. In the meanwhile, the second and third seal members 188, 189 are in contact with the tubular portion 33. Therefore, water flows out from the side holes 186 and enters into the second chamber 48 and the through holes via the gap. The water flows out from the orifices 193 and along the cone-shaped openings 194.

Figure 6:
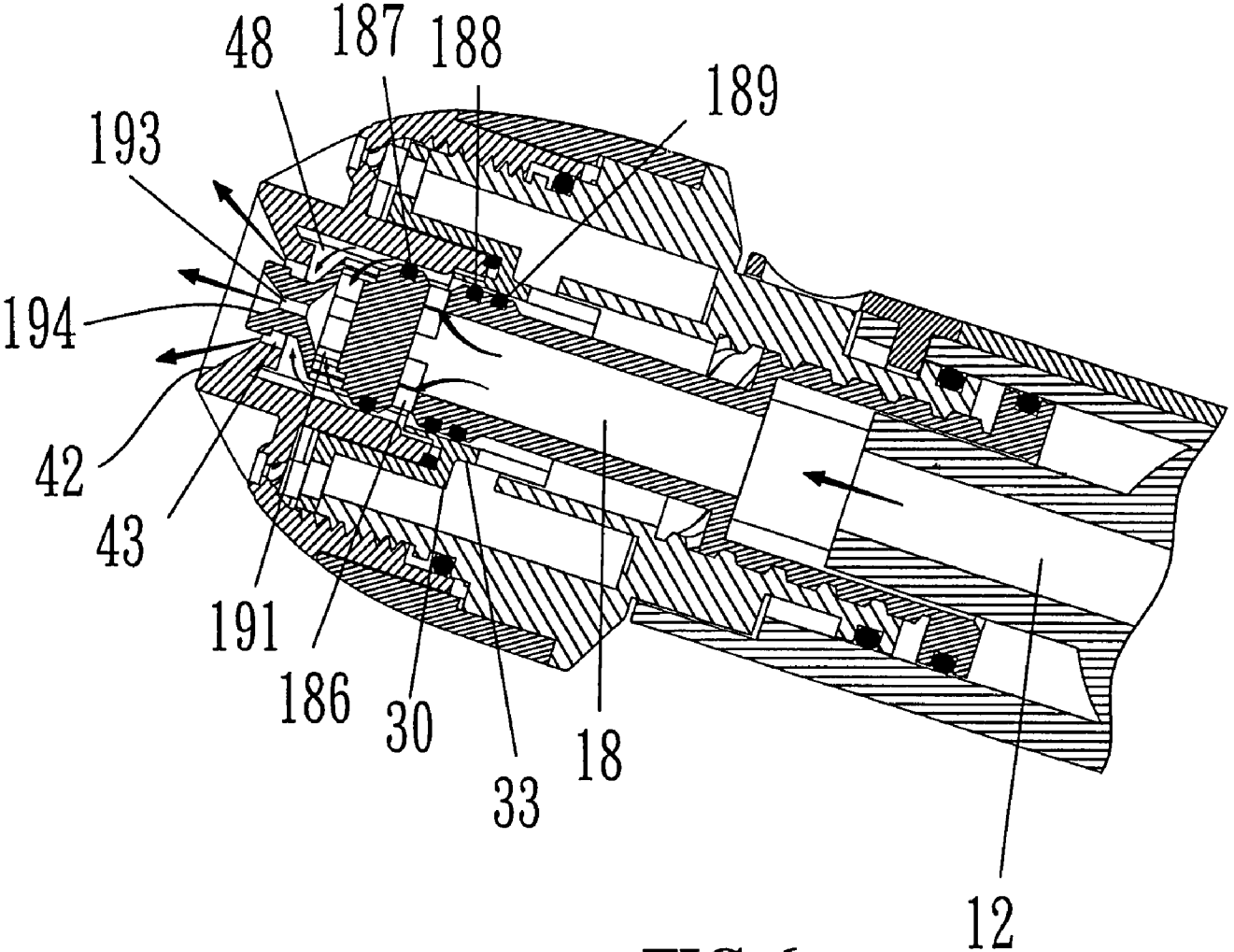

As shown in FIG. 6, when rotating the outlet device 200 to move the adjustment member 18 to let the inclined surface 195 remove from central hole 43, the second and third seal members 188, 189 still seal the tubular portion 33 so that water cannot enter into the first chamber 25. The water flows out from the side holes 186 and enters into the second chamber 48, and flow through the gap between the first seal member 187 and the second inner tube 45. In the meanwhile, a part of the water flows out from the orifices 193 and along the cone-shaped opening 194. The other part of the water flows through the neck 192 and out from the central hole 43. The water flows along the divergent cone-shaped surface 42 to form a divergent water stream.

Figure 7:
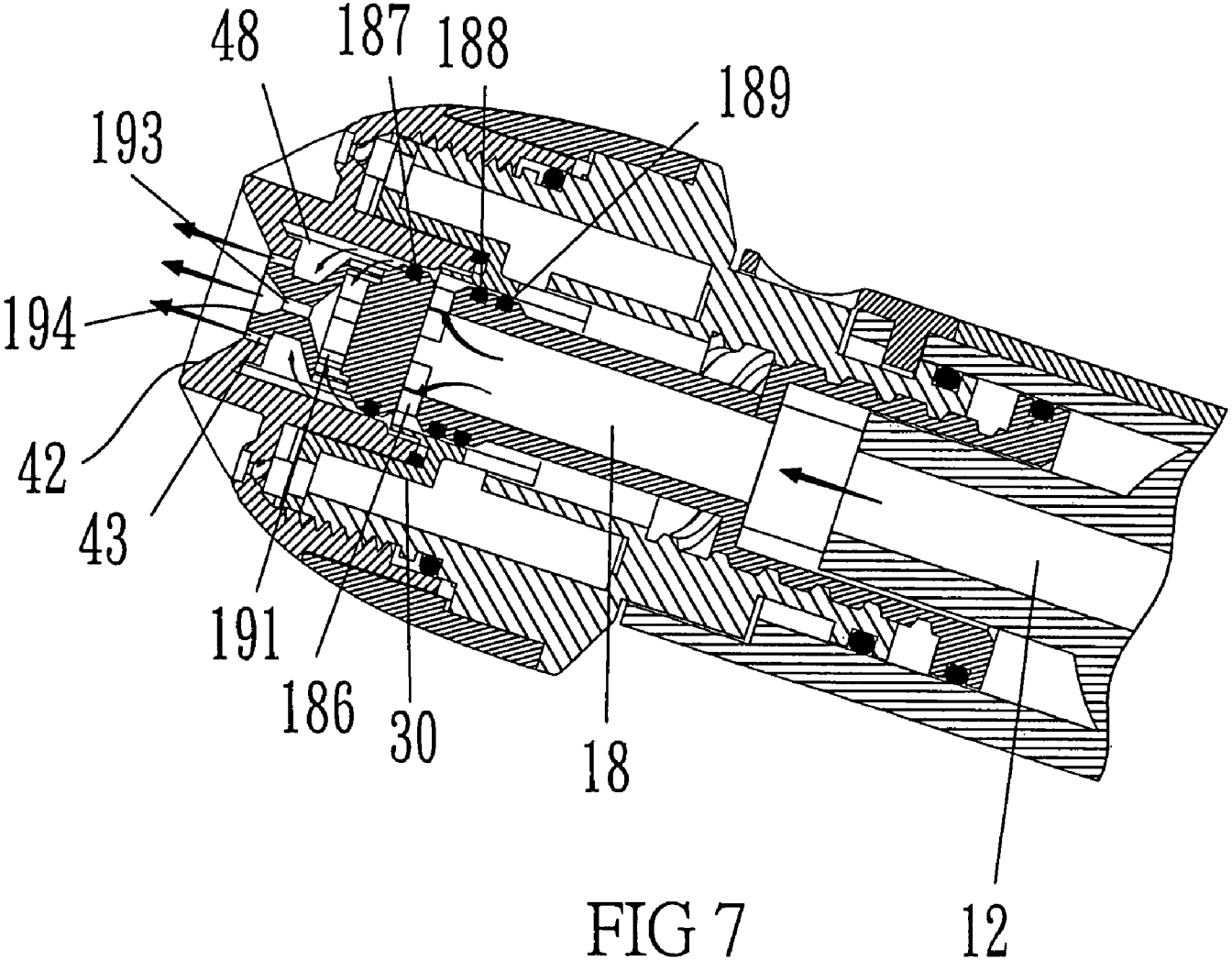

FIG. 7 shows that when further rotating the outlet device 200, front end of the end part 19 of the adjustment member 18 is located in the central hole 43 and in flush with the periphery of the central hole 43. The first, second and third seal members 187, 188 and 189 are located at the positions the same as shown in FIG. 6 and the water flows into the nozzle member 40 is the same as described in FIG. 6. However, a circular gap is defined between the beck 192 and the periphery of the central hole 43, the water stream is a straight stream.

Figure 8:
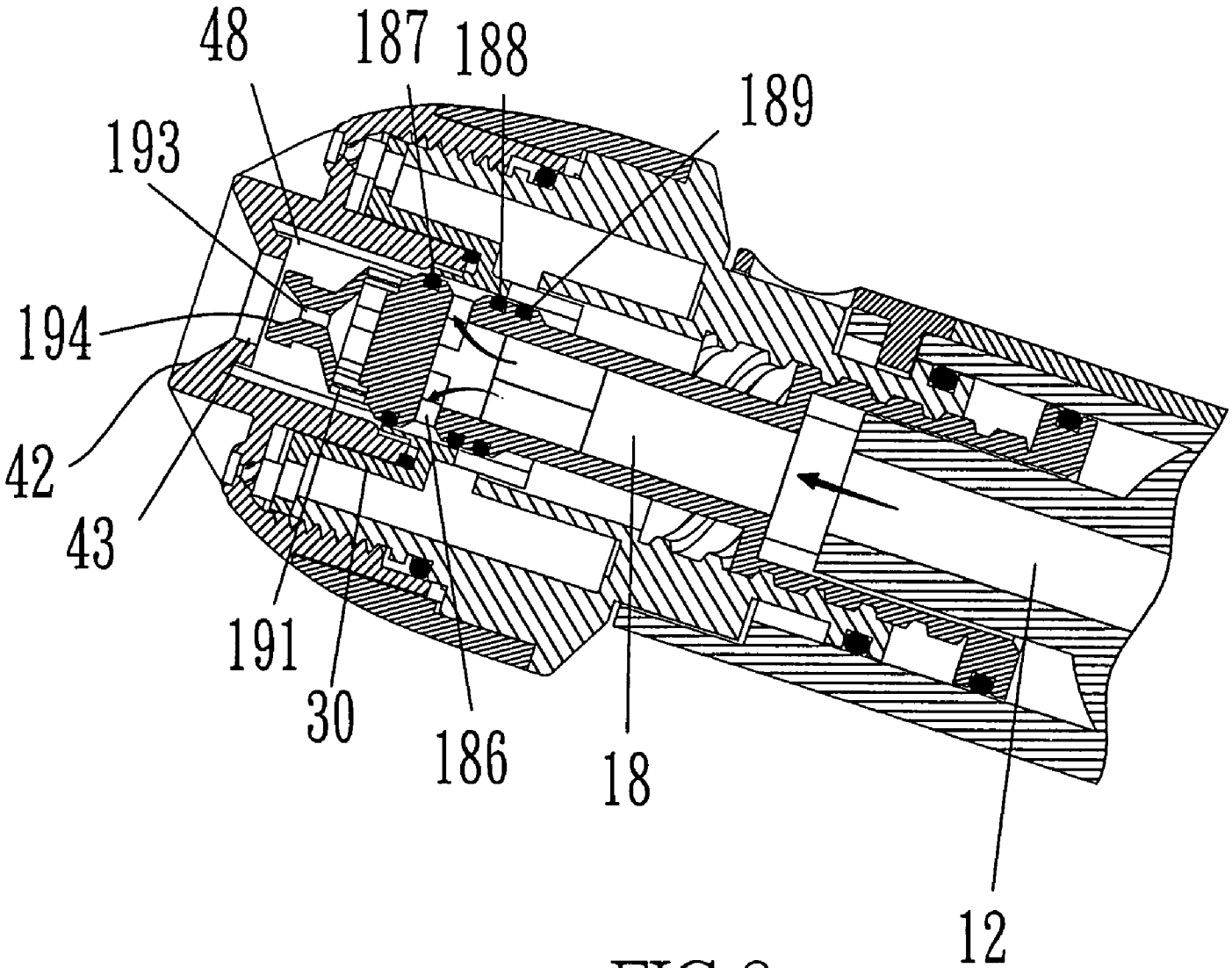

FIG. 8 shows that when the adjustment member 18 is moved such that the first, second and third seal members 187, 188 and 189 are located in the intermediate member 30 and the tubular portion 33, the watering nozzle assembly is in a sealed status.

Figure 9:
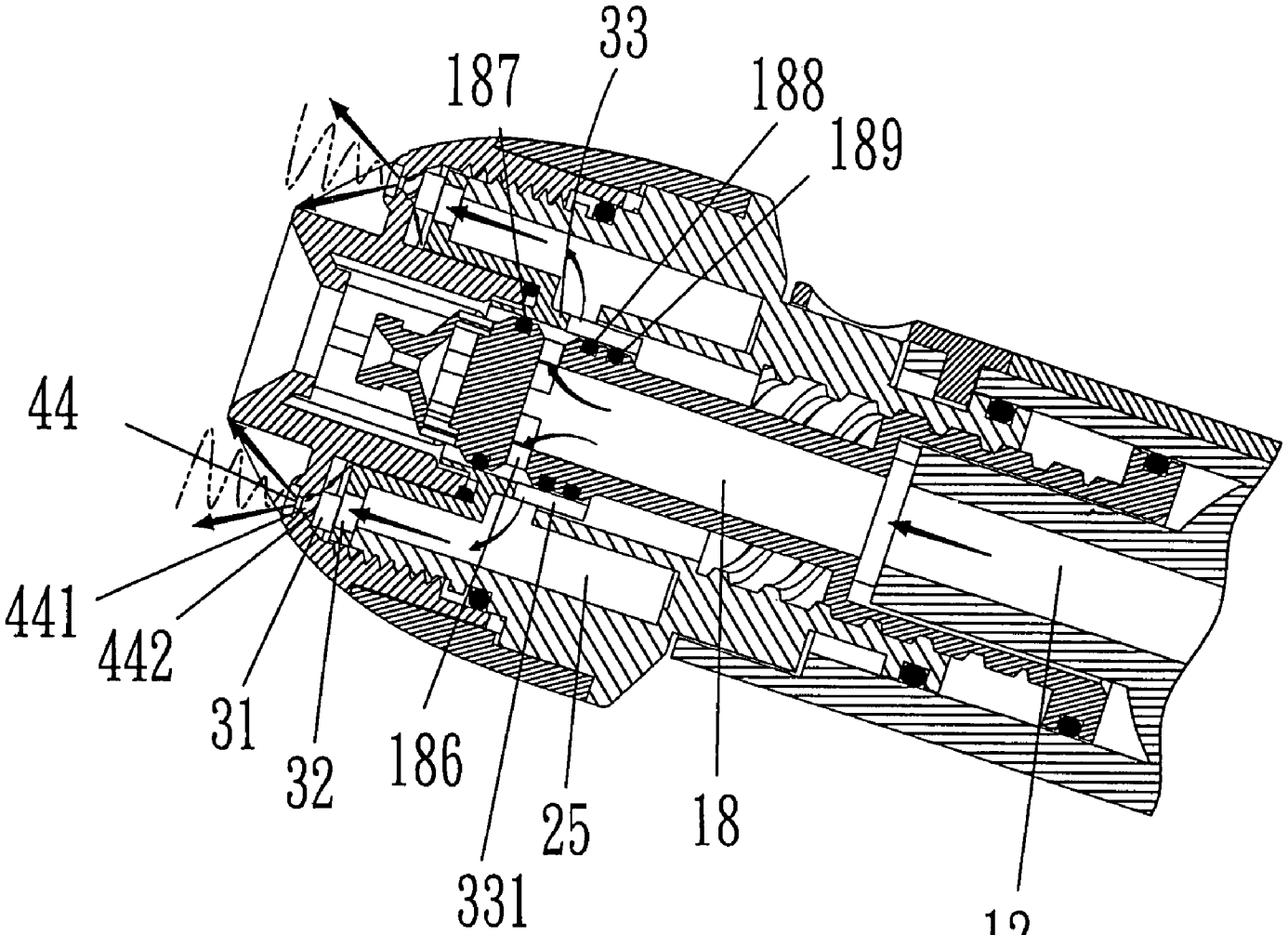

FIG. 9 shows that when the cone-shaped recesses 441 are sealed by the rods 31 and a part of each of the spiral grooves 442 exposed beyond the rods 31. The side holes 186 of the adjustment member 18 are located at the slots 331 of the tubular portion 33, the first seal member 187 seals the tubular portion 33 such that water cannot enter into the second chamber 48. The second and third seal members 188, 189 are located at the slots 331 so that the water coming from the side holes 186 enters into the first chamber 25 via the slots 331 and flows through the passages 32 and enters the spiral grooves 442. The water then flows into the apertures 44 and the cone-shaped recesses 441. Therefore, the water goes out from the apertures 44 like mist. As shown in FIG. 2-2, the cone-shaped recesses 441 defined in an inner periphery of the nozzle member 40 are sized to be larger than that of the rods 31 of the intermediate member 30 so that when the rods 31 are inserted into the cone-shaped recesses 441, an annular gap is defined between the periphery of the cone-shaped recess 441 and the rod 31. It is noted that the connection of the intermediate member 30 and the nozzle member 40 can also be made by way of ultra-sonic welding to ensure that there is no relative rotation between the intermediate member 30 and the nozzle member 40.

While we have shown and described the embodiment in accordance with the present invention, it should be clear to those skilled in the art that further embodiments may be made without departing from the scope of the present invention.

What is claimed is:

1. A watering nozzle assembly comprising:

a handle with an inlet tube received therein and a barrel connected to the handle, an outlet tube connected to the inlet tube and received in the barrel, an adjustment member received in the barrel and an outlet device connected to the adjustment member, the outlet device including a rotatable member, a collar mounted to the rotatable member and a nozzle member connected to the rotatable member, an intermediate member located between a first inner tube of the rotatable member and a second inner tube of the nozzle member, one side of the intermediate member having a plurality of rods and passages, a tubular portion extending from the other side of the intermediate member and inserted into the first inner tube of the rotatable member, a plurality of slots defined in the tubular portion, the nozzle member including a divergent cone-shaped surface and a central hole, a plurality of apertures defined in an outer periphery of the nozzle member, a plurality of cone-shaped recesses defined in an inner periphery of the nozzle member and enclosing the apertures respectively, a plurality of spiral grooves defined in each of the cone-shaped recesses, the cone-shaped recesses being sealed by the rods and a part of each of the spiral grooves exposed beyond the rods so that mist water goes out from the apertures via the spiral grooves.

2. The assembly as claimed in claim 1, wherein the outlet tube includes rails and the adjustment member includes guide grooves with which the rails are movably engaged.

3. The assembly as claimed in claim 1, wherein the adjustment member includes an outer threaded section and a flange extends radially from a first end of the adjustment member, a groove is defined in an outer periphery of the flange and a seal is engaged with the groove so as to be in contact with an inner periphery of the barrel, a second end of the adjustment member is a closed end and includes side holes defined a wall thereof, a first seal member, a second seal member and a third seal member are respectively mounted to the adjustment member, the side holes are located between the first and second seal members, an end part is mounted to the second end of the adjustment member and includes a plurality of through holes, a neck is defined in a distal end of the end part and an orifice is defined axially in the neck and communicates with the through holes, the orifice defines a cone-shaped opening in a distal end of the neck.

4. The assembly as claimed in claim 1, wherein the rotatable member includes an annular groove and a seal is engaged with the annular groove and in contact with an inner periphery of the barrel, a retaining member is mounted on the barrel and includes studs on an inner periphery thereof such that the studs are engaged with a retaining groove defined beside the annular groove of the rotatable member.

5. The assembly as claimed in claim 1, wherein the rotatable member includes an inner threaded hole and the outer threaded section of the adjustment member is threadedly connected to the inner threaded hole, a first chamber is defined between the first inner tube of the rotatable member and an outer threaded tube on an end of the rotatable member.

6. The assembly as claimed in claim 1, wherein a plurality of blocks extending radially from the rotatable member and the collar is mounted to the rotatable member, the collar includes engaging grooves defined in an inner periphery thereof so as to be engaged with the blocks.

7. The assembly as claimed in claim 1, wherein a plurality of inner grooves are defined in the tubular portion of the intermediate member and the second inner tube of the nozzle member includes ribs which are movably engaged with the inner grooves.

8. The assembly as claimed in claim 5, wherein the nozzle member includes an inner threaded section which is connected to the outer threaded tube of the rotatable member.

9. The assembly as claimed in claim 1, wherein a seal is clamped between the rotatable member and the nozzle member, another seal is clamped between the second inner tube and the adjustment member.

* * * * *